US008480040B2

(12) United States Patent
Pacheco et al.

(10) Patent No.: US 8,480,040 B2
(45) Date of Patent: Jul. 9, 2013

(54) MOUNTING ARRANGEMENT FOR THE ENERGIZING CABLES OF AN ELECTRIC MOTOR OF A REFRIGERATION COMPRESSOR

(75) Inventors: Anderson Ricardo Pacheco, Joinville (BR); Claudio Roberto Hille, Joinville (BR)

(73) Assignee: Whirlpool S.A., São Paulo-Sp (BR)

( * ) Notice: Subject to any disclaimer, the term of this patent is extended or adjusted under 35 U.S.C. 154(b) by 195 days.

(21) Appl. No.: 12/598,883

(22) PCT Filed: May 6, 2008

(86) PCT No.: PCT/BR2008/000131

§ 371 (c)(1),
(2), (4) Date: Jan. 21, 2010

(87) PCT Pub. No.: WO2008/134838

PCT Pub. Date: Nov. 13, 2008

(65) Prior Publication Data

US 2010/0148016 A1 Jun. 17, 2010

(30) Foreign Application Priority Data

May 7, 2007 (BR) ..... 0701686

(51) Int. Cl.
*F16L 3/22* (2006.01)

(52) U.S. Cl.
USPC ..... 248/68.1; 248/74.2; 62/259.1

(58) Field of Classification Search
USPC ..... 248/68.1, 74.2, 50, 51; 62/259.1
See application file for complete search history.

(56) References Cited

U.S. PATENT DOCUMENTS 3,894,706 A * 7/1975 Mizusawa ..... 248/68.1
4,163,372 A * 8/1979 Frye et al. ..... 62/259.1

(Continued)

FOREIGN PATENT DOCUMENTS

CN 1953288 A 4/2007
CN 1953289 A 4/2007

(Continued)

OTHER PUBLICATIONS

XP002542841; Databae WPI; Section EI, Apr. 25, 2007, Thomson Scientific, AN 2007-614 074.

*Primary Examiner* — Bradley Duckworth
(74) *Attorney, Agent, or Firm* — Gifford, Krass, Sprinkle, Anderson & Citkowski, P.C.

(57) ABSTRACT

The invention refers to a mounting arrangement for the energizing cables of an electric motor of a refrigeration compressor, the electric motor being mounted in the interior of a casing of the compressor and the energizing cables presenting an end connected to the electric motor and an opposite end operatively connected to an electric current power source, external to the casing, through the latter. The arrangement includes at least one immobilizing means mounted internally to the casing, so as to retain the energizing cables, maintaining at least part of the extension thereof in a predetermined positioning in the interior of the casing.

12 Claims, 8 Drawing Sheets

U.S. PATENT DOCUMENTS

| | | | | |
|---|---|---|---|---|
| 4,346,568 | A * | 8/1982 | Perrone et al. | 62/259.1 |
| 5,399,812 | A * | 3/1995 | Woszczyna et al. | 174/97 |
| 6,038,852 | A * | 3/2000 | Celi | 60/761 |
| 7,500,644 | B2 * | 3/2009 | Naudet et al. | 248/68.1 |
| 7,712,708 | B2 * | 5/2010 | Clark | 248/74.4 |
| 2007/0215757 | A1 * | 9/2007 | Yuta | 248/68.1 |
| 2008/0017761 | A1 * | 1/2008 | Hashimoto | 248/68.1 |
| 2008/0197241 | A1 * | 8/2008 | Bauer | 248/68.1 |
| 2010/0006709 | A1 * | 1/2010 | Bleus et al. | 248/68.1 |

FOREIGN PATENT DOCUMENTS

| | | | |
|---|---|---|---|
| JP | 55049065 | A | 3/1980 |
| JP | 02053253 | U | 4/1990 |
| JP | 4175477 | A | 6/1992 |
| JP | 10159729 | A | 6/1998 |
| JP | 2000297758 | A | 10/2000 |

* cited by examiner

MOUNTING ARRANGEMENT FOR THE ENERGIZING CABLES OF AN ELECTRIC MOTOR OF A REFRIGERATION COMPRESSOR

This application is the US National Phase Application under 35 U.S.C. §371 of International Patent Application No. PCT/BR2008/000131 filed May 6, 2008, which claims priority to and the benefit of Brazilian Patent Application No. PI0701686-7, filed May 7, 2007, each of which is hereby incorporated by reference in its entirety. The International Application published as WO 2008/134838 A2 on Nov. 13, 2008.

FIELD OF THE INVENTION

The present invention refers to an arrangement for mounting and affixing an electric energizing cable provided in the interior of the casing of a refrigeration compressor, particularly the electrical connection cables that connect, in the interior of the hermetic casing of the compressor, the coil elements of the stator of the electric motor to an electric plug disposed in the casing of the compressor.

BACKGROUND OF THE INVENTION

Refrigeration compressors present, lodged in the interior of a generally hermetic casing, a motor-compressor assembly for pumping refrigerant fluid to a refrigeration system to which said compressor is coupled.

Refrigeration compressors in general, and particularly the linear compressors, have as a characteristic inherent to the concept of compression, the motor-compressor assembly thereof presenting a great displacement in the interior of the casing, in an oscillating movement.

The compression assembly must be supplied with electric energy by means of electric cables which connect the casing to the motor of the motor-compressor assembly.

The electric motor of a refrigeration compressor is generally supplied by electric current from a power source external to the casing, by connecting appropriate wiring electrically connected to the electric motor. In these constructions, the connection of the electric motor to the electric current power source occurs by connecting the energizing cables, generally in number of three, to an electric plug mounted outside the hermetic casing and which is electrically connected to the electric motor.

In these constructions, the energizing cables that connect the electric motor to the power source are suspended in the interior of the casing of the compressor, between the electric motor and the inner electric plug of said casing.

One of the consequences of this suspended arrangement is the stress imposed to the end portions of said energizing cables that are affixed to the parts of electric motor and casing, which can result in break of the electrical connection in these regions. Another consequence of this type of this mounting arrangement is that said motor energizing cables may slide in the casing, which conditions may cause wear in the insulation of the cables and, consequently, short circuit of this exposed part with the casing. Such situation represents a high risk for the user, besides impairing the supply of electric energy to the electric motor of the compressor.

SUMMARY OF THE INVENTION

It is an object of the present invention to provide a mounting arrangement for the energizing cables of an electric motor of a refrigeration compressor, which prevents the occurrence of wear in the insulation of the energizing cables and, consequently, of short circuit of this worn out part in contact with the casing, further avoiding electric shocks to the user.

It is another object of the present invention to provide an arrangement as cited above, which prevents the swinging of the energizing cables suspended within the compressor casing, between the electric motor and the inner plug of the compressor casing, without the disadvantages of breaking the electric connections to the motor and to the inner plug of the casing, and without impairing the supply of electric energy to the motor of the compressor.

A further object of the present invention is to provide a mounting arrangement, as cited above, which is easily carried out, has reduced cost and also allows the mounting and fixation of the energizing cables in the interior of the casing of the compressor to be carried out in a substantially automated form.

These and other objects of the present invention are achieved through a mounting arrangement for the energizing cables of an electric motor of a refrigeration compressor, said motor being mounted in the interior of a casing of the compressor and said energizing cables presenting an end connected to the electric motor and an opposite end operatively connected to an electric current power source provided outside the casing, through the latter, the mounting arrangement of the present invention comprising at least one immobilizing means mounted inside the casing, so as to retain the energizing cables, maintaining at least part of the extension thereof in a predetermined positioning in the interior of the casing.

The immobilizing means comprises at least one cradle for each energizing cable or also for a plurality of said energizing cables.

BRIEF DESCRIPTION OF THE DRAWINGS

The invention will be described below, with reference to the enclosed drawings, given by way of example of an embodiment of the invention and in which.

DESCRIPTION OF THE ILLUSTRATED EMBODIMENTS

Figure 1:
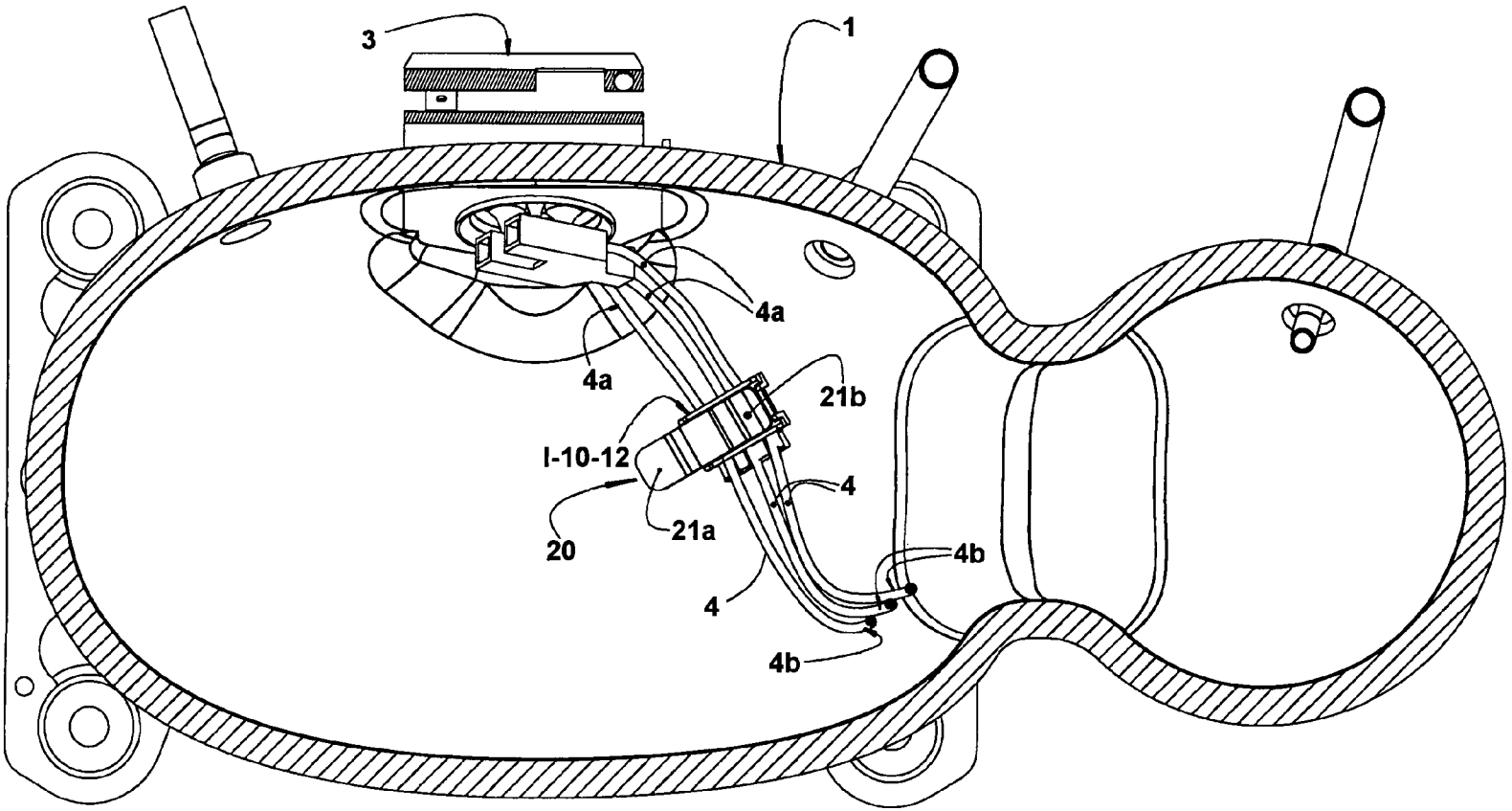
FIG. 1 schematically represents, in a top plan view, a body portion of the casing of a refrigeration compressor, illustrating, in the interior thereof, the energizing cables of the electric motor of the compressor that are connected to an electric plug provided in said casing, said energizing cables being affixed to the casing, according to the mounting arrangement of the present invention.
Figure 2:
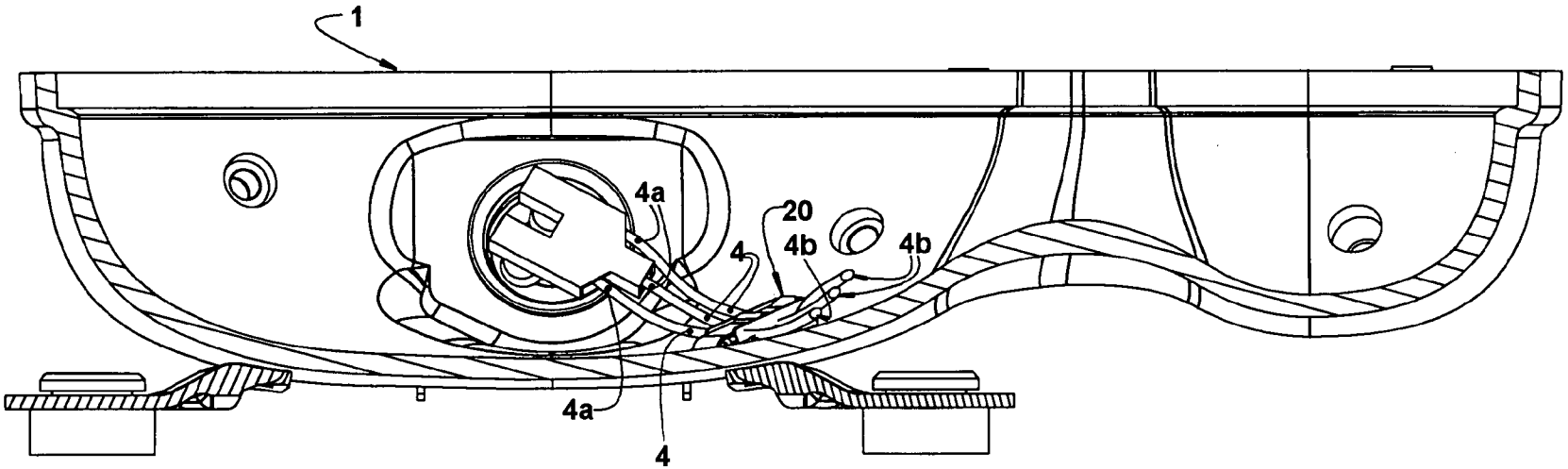
FIG. 2 schematically represents a side sectional view of the body portion of the casing illustrated in FIG. 1, in the fixation region of the energizing cables.
Figure 3:
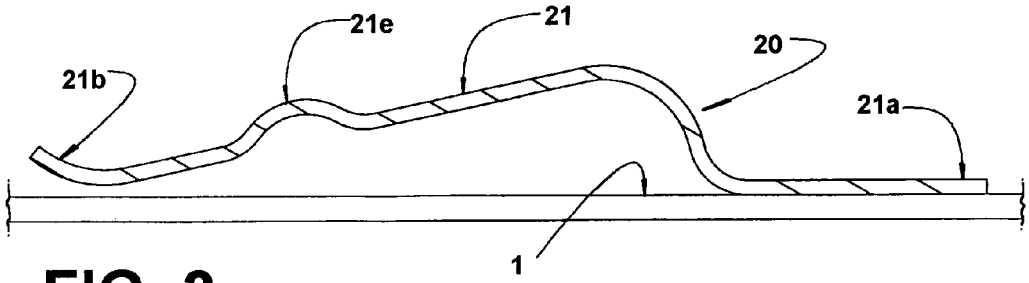
FIG. 3 schematically represents a side sectional view of a gripping means construction of the immobilizing means of the present invention illustrated in FIGS. 1 and 2.
Figure 4:
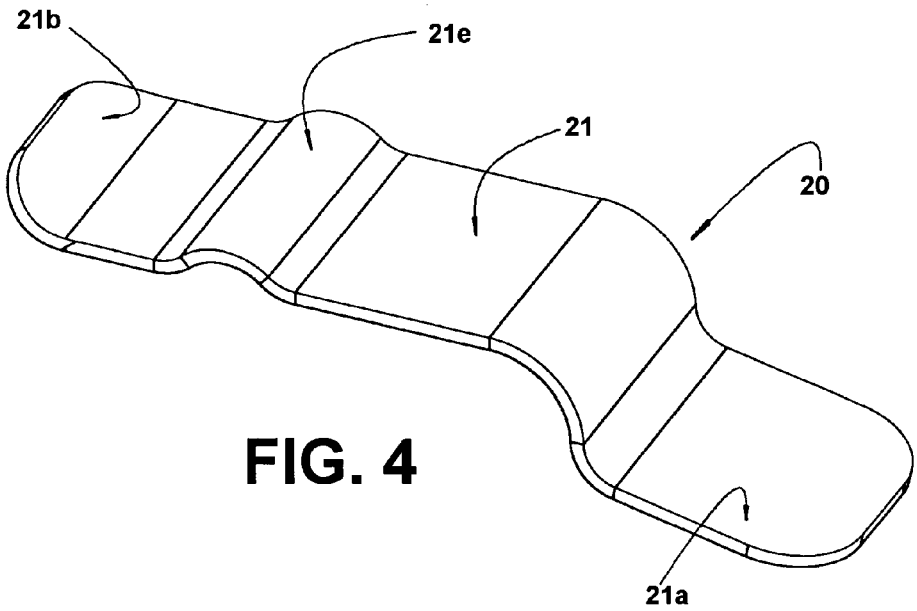
FIG. 4 schematically represents a top perspective view of the gripping means construction of the immobilizing means illustrated in FIG. 3.
Figure 5:
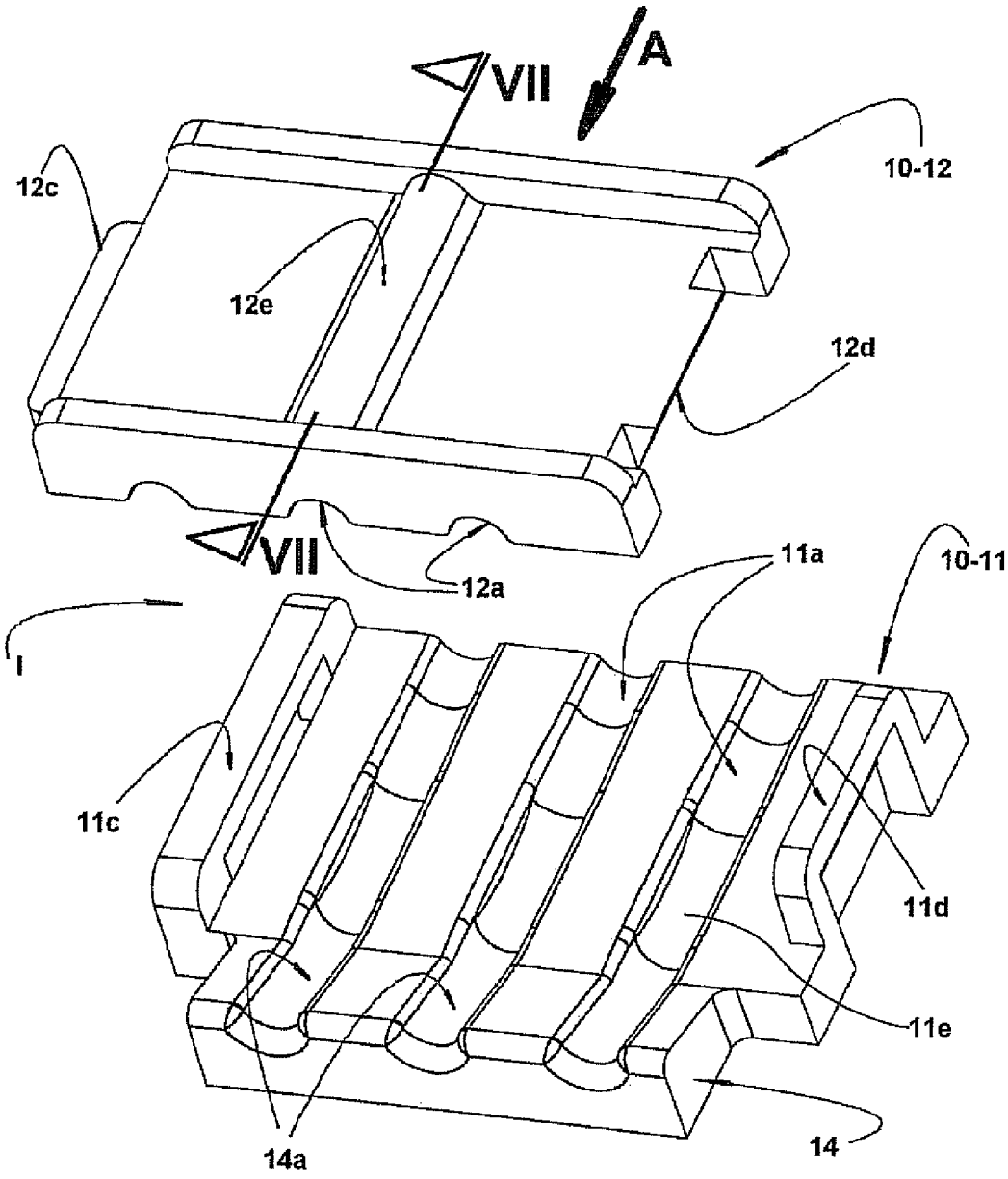
FIG. 5 schematically represents an exploded perspective view of the two cradle portions of the immobilizing means construction of the present invention, illustrated in FIGS. 1 and 2.
Figure 6:
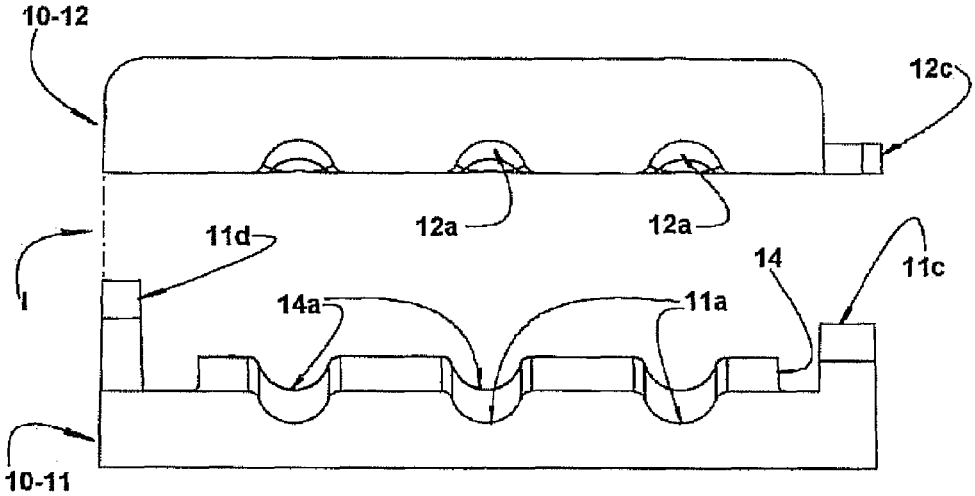
FIG. 6 schematically represents an exploded side view of the two cradle portions of the immobilizing means construction of the present invention, taken according to line A illustrated in FIG. 5.
Figure 7:
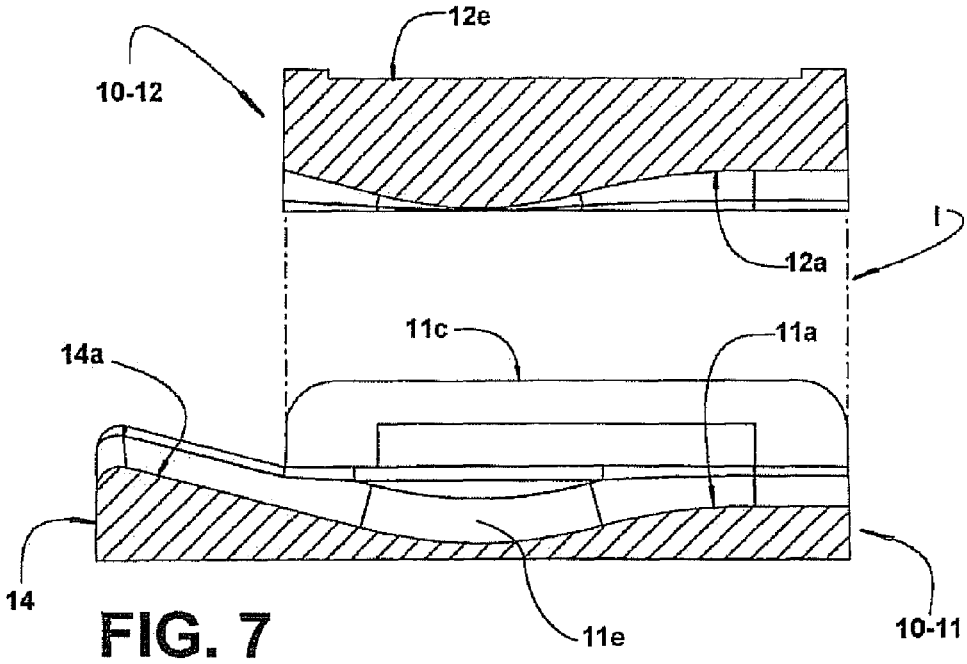
FIG. 7 schematically represents, in an exploded view, a cross section of the two cradle portions of the immobilizing means construction of the present invention, taken according to line VII-VII illustrated in FIG. 5.

The mounting arrangement of the present invention is applied to a refrigeration compressor of the type which comprises a hermetic casing 1, inside which is mounted, generally by suspension, a motor-compressor assembly formed by a cylinder block to which is affixed an electric motor 2.

The electric motor 2 is fed with current from an appropriate electric current power source (not illustrated), through an electrical connection between this electric current power source and a plug 3, carried by the casing 1, through an opening provided therein and which is electrically connected to the electric motor 2 of the compressor.

The supply of electric current to the electric motor 2, from the plug 3 of the compressor, is carried out through energizing cables 4, generally in number of three, which are electrically connected to conducting wires of a stator of the electric motor 2. Each energizing cable 4 presents an end 4*a* connected to the electric motor 2, as described above, and an opposite end 4*b* operatively connected to the power source external to the casing 1, through the latter, by electrical connection to the plug 3.

To avoid the problems of the prior art constructions, the present invention provides a mounting arrangement for the energizing cables 4 of the electric motor 2 which comprises at least one immobilizing means I, to be described below, mounted internally to the casing 1 of the compressor, so as to retain, in relation to said casing, the energizing cables 4 in its interior, maintaining at least part of the extension of said energizing cables 4 in a predetermined positioning in the interior of the casing 1.

The immobilizing means I of the present invention comprises at least one cradle 10 to receive all the energizing cables 4, which are jointly arranged side by side, or also a plurality of cradles 10, defined so that each energizing cable 4 has its cross section at least partially lodged in a respective cradle 10, disposed laterally adjacent to another cradle 10, and lodging another energizing cable 4, the extension of each energizing cable 4, inside the casing 1, being retained in at least one cradle 10.

In the illustrated construction, the cradles 10 are arranged in a set of cradles 10, which are laterally adjacent to one another, according to the same lateral alignment. However, it should be understood that said cradles 10 can be arranged defining at least one set of cradles laterally adjacent to one another. In this construction, the arrangement of the cradles 10 can be of alignment or also defined so that at least one of the cradles 10 of said set of cradles is spaced back in relation to the others. Furthermore, the present solution allows the provision of immobilizing means I of the type described herein, which comprise sets of cradles aligned to each other and to the length of the energizing cables 4, so that each energizing cable 4 has the respective portion of its longitudinal extension lodged in a cradle 10 of each set of cradles 10, for example, of one alignment of set of cradles.

In some constructive forms of immobilizing means I to be described below, both in the construction of a single cradle 10 and of a plurality of cradles 10, the latter are defined between two parts pressed together, so as to laterally embrace, with a certain pressure, a respective energizing cable 4, said certain pressure being obtained, for example, through an elastically deformable element presenting elastic memory, or through a gripping means, for example, in the form of a pressure bolt, rivet, clamp, etc.

Figure 8:
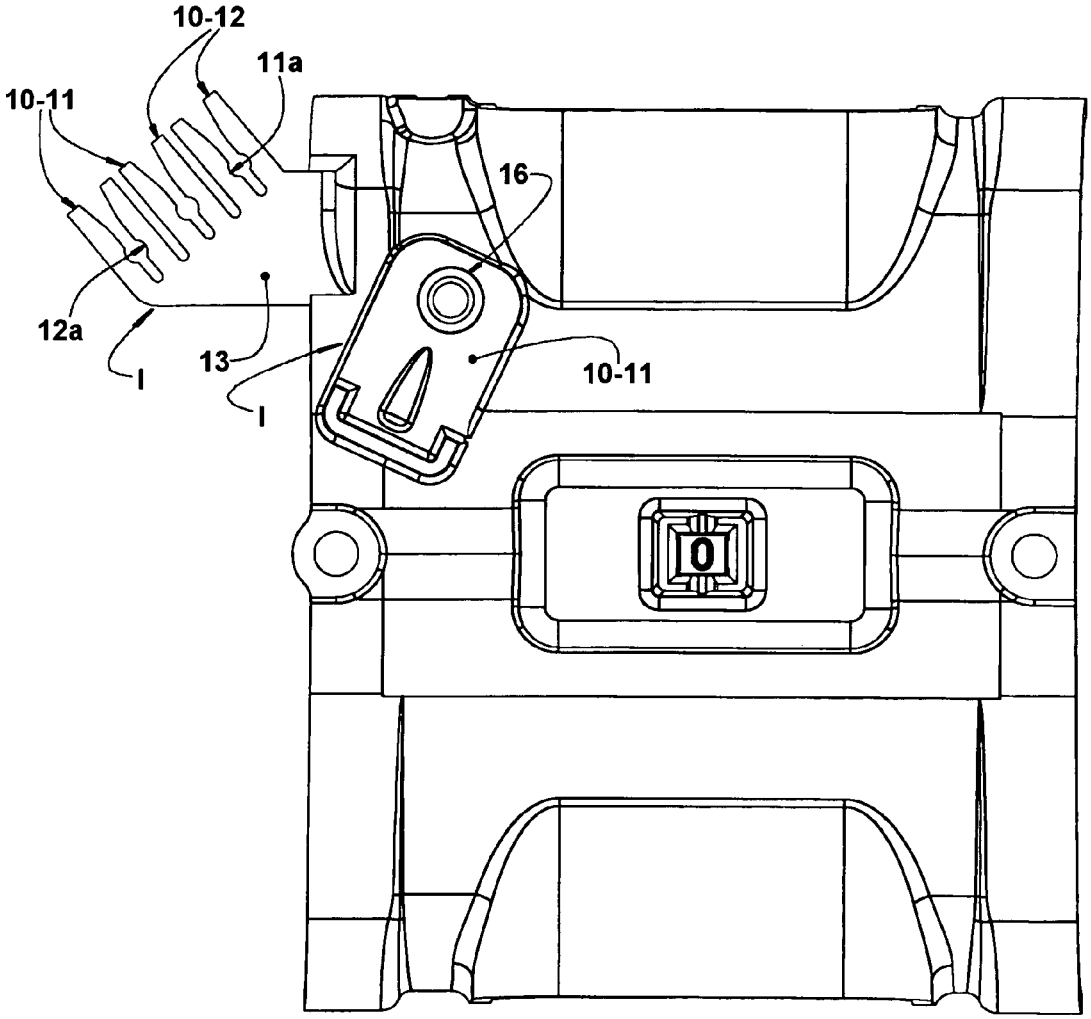
FIG. 8 schematically represents an enlarged view of part of an acoustic filter of the compressor, carrying two other immobilizing means constructions of the present invention, one of which presenting only one of its cradle portions mounted to said acoustic filter.
Figure 9:
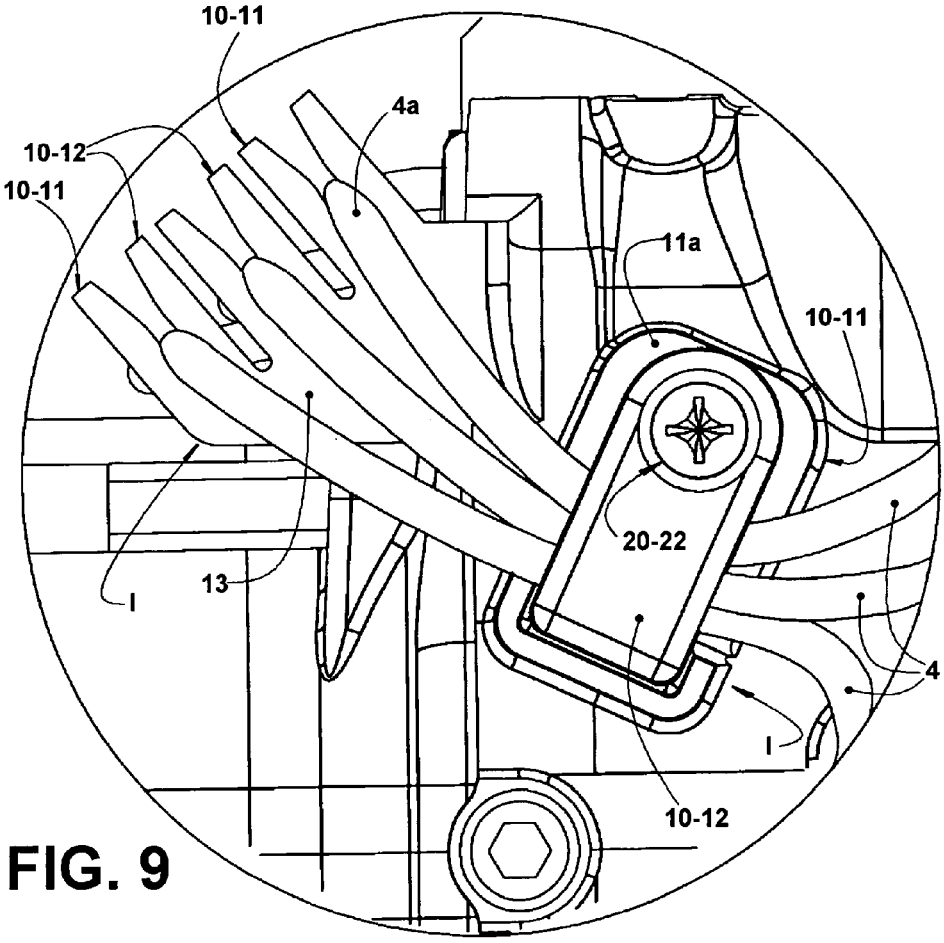
FIG. 9 schematically represents an enlarged view of the acoustic filter region carrying the two immobilizing means constructions illustrated in FIG. 8.
Figure 10:
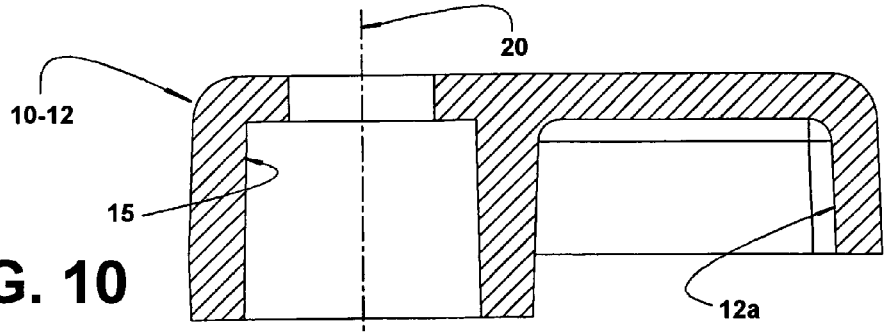
FIG. 10 schematically represents a longitudinal sectional view of a cradle portion complementary to that mounted in the acoustic filter illustrated in FIGS. 8 and 9.
Figure 11:
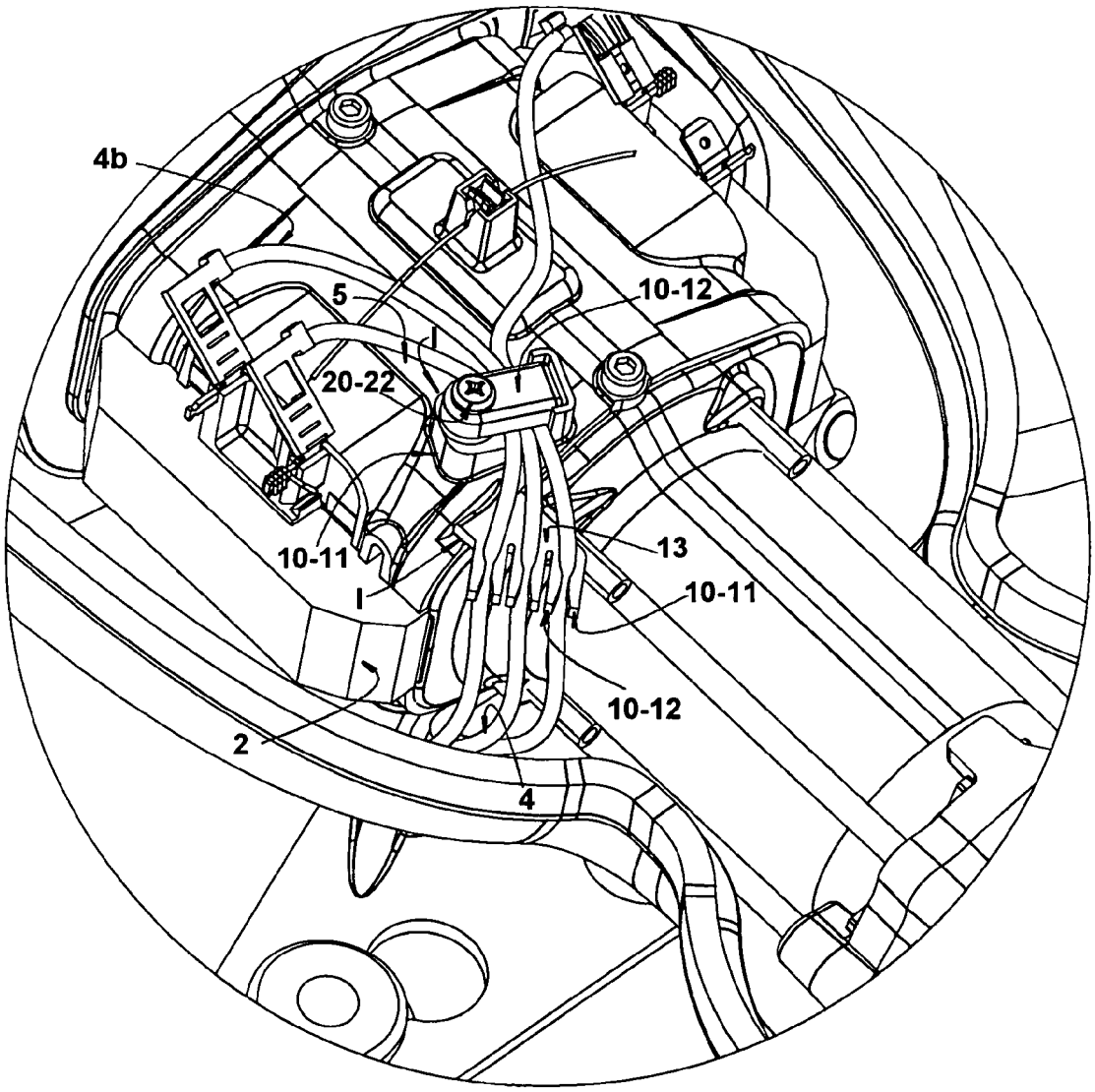
FIG. 11 schematically represents a perspective view of the immobilizing means construction illustrated in figure and having mounted thereto, through another gripping means construction, a cradle portion illustrated in FIG. 10.

According to a way of carrying out the present invention, illustrated in FIGS. 8 and 9, the immobilizing means I comprises a plurality of cradles 10, each defined between two cradle portions 11, 12 which laterally embrace and press a respective energizing cable 4. In this construction, each cradle 10 has a first and a second cradle portion 11, 12, said two cradle portions 11, 12 being elastically deformable upon lodging a respective energizing cable 4 therebetween, so as to exert, by elastic memory, a lateral pressure over said energizing cable 4, enough to retain it in the interior of the cradle 10.

Each cradle portion 11, 12 of each cradle 10 presents a respective median recess 11*a*, 12*a*, to lodge a cross sectional portion of an energizing cable 4, immobilized in said cradle 10.

According to a way of carrying out the present invention, the first and second cradle portions 11, 12 of each cradle 10 are defined in a single piece, said cradle portions 11, 12 being incorporated to a common base body 13, through which said cradle portions 11, 12 are affixed to the casing 1 of the compressor. In a particular form of this construction, each cradle 10 formed by the cradle portions 11, 12 is entirely defined in a single piece. More particularly, said cradles 10 thus defined in a single piece are incorporated, also in a single piece, to the base body 13.

In the construction illustrated in FIGS. 8 and 9, each cradle 10 is externally incorporated to the surface of an acoustic filter 5 provided in the interior of the casing 1, said acoustic filter 5 being, for example, a suction acoustic filter of the type to be mounted close to a head which closes an end of the compression cylinder of the refrigeration compressor.

In a particular arrangement of the present invention, illustrated in the enclosed drawings, the cradles 10 projecting from the base body 13 are externally incorporated, in a single piece, to the acoustic filter 5.

In this construction, the immobilizing means I comprises a set of cradles 10 in the form of superiorly opened fingers, through which are introduced, under pressure, the energizing cables 4, until each of said cables 4 reaches the respective cradle 10, remaining lodged therein. This construction retains the energizing cables 4 in relation to the casing 1, maintaining them laterally spaced from each other and from the inner surface of the casing 1 and also from the nearest surface defined by the outer surface of the acoustic filter 5, avoiding the wearing contact and also the swinging movement of said loose energizing cables 4 in the interior of the casing 1. Although the illustrated construction presents each cradle 10 defined by respective cradle portions 11, 12, there are also possible solutions in which said cradles share at least one of their cradle portions 11, 12 with an immediately adjacent cradle 10. It should also be noted that the immobilizing means I constructed in the form of fingers, as described herein, can be used to retain, in a laterally spaced form, different extension segments of the energizing cables 4 along the extension thereof inside the casing 1, said construction in the form of fingers presenting at least one set of laterally adjacent cradles 10. Such distribution of cradles 10 can also be applied to the other constructions of immobilizing means I described herein.

According to the present invention, in another constructive form of immobilizing means I, as previously defined, this comprises a first and a second cradle portion 11, 12, defined in separate pieces, one of them being affixed to the compressor, inside the casing 1 of the compressor, by at least one element, such as: screw, glue, rivet, welding, clamp, etc. The other cradle portion 11, 12 is affixed and pressed to the first cradle portion 11, 12, by at least one gripping means 20 comprising, for example, a clamp 21, such as a flexible clamp, affixed to both the casing 1 and the first cradle portion 11 and being shaped so as to press the first cradle portion 11 against the second cradle portion 12, constantly maintaining the two cradle portions 11, 12 seated to each other and against at least one energizing cable 4.

In this construction, illustrated in FIGS. 1-7, each cradle portion 11, 12 has a plurality of median recesses 11*a*, 12*a*, each lodging a respective cross section portion of the energizing cable 4 immobilized in said cradle 10.

In this construction, each cradle portion 11, 12, presents a cross section which defines part of the cross section of each energizing cable 4 to be lodged therein. Upon closing the cradle 10, each said cradle portion 11, 12 thereof partially or totally complements the contour of part of a respective energizing cable 4 lodged therein.

In the illustrated construction, the first cradle portion 11 comprises a rear projection 14, for anchoring and directioning each energizing cable 4 lodged in the recesses 11*a* of said first cradle portion 11, said rear projection 14 being provided with respective recesses 14*a*, each aligned with a recess 11*a* of the first cradle portion 11. In this construction, each recess 11*a* of the first cradle portion 11 presents a softened contour, for example, a curved profile, which forms a depression 11*e* with respect to an outer surface of the recess, so as to lodge a portion of the energizing cable 4, without submitting this to bending forces which can break the electrical wiring of said energizing cable 4, interrupting the supply of electric current to the electric motor 2, impairing the operation of the compressor.

In the illustrated construction, the first cradle portion 11 presents, laterally to the set of recesses 11*a*, end side projections 11*c*, 11*d*, in the form of handles, for affixing the second cradle portion 12 to said first cradle portion 11, so as to close the cradles 10 of the set of cradles of this construction, before the provision of a gripping means 20, for example in the form of a flexible clamp 21, as already described.

A first end side projection 11*c* is shaped to define an opening to receive and fit a side projection 12*c* of the second cradle portion 12, upon mounting the latter to the first cradle portion 11. A second end side projection 11*d* is shaped to receive and retain at least one fitting tongue 12*d* of the second cradle portion 12 provided, for example, through an end side face of the second cradle portion 12. In the illustrated construction, the second cradle portion 12 presents a single fitting tongue 12*d*, inclined from the face of said second cradle portion 12 provided with the recesses 12*a*, said fitting tongue 12*d* having an engaging face to be seated against an inner face of the opening of the adjacent second end side portion 11*d* of the first cradle portion 11, upon fitting the two cradle portions 11, 12 together.

In order to mount and affix the two cradle portions 11, 12 of this construction, the side projection 12*c* of the second cradle portion 12 is initially fitted into one of the handles 11*c* of the first cradle portion 11, being introduced in an opening of the first end side projection 11*c*, said opening being previously conformed so as to define a window dimensioned for fitting, for example tightly, said side projection 12*c*.

In the illustrated construction, the first end side projection 11*c* is provided external to the region of the first cradle portion 11 carrying the recesses 11*a*, externally to the compression region between the two cradle portions 11, 12.

After introducing the side projection 12*c* in the opening of the first end side projection 11*c*, the second cradle portion 12 is moved angularly around an axis defined in the mounting region of said side projection 12*c* in the first end side projection 11*c*, transversally to the longitudinal axis of the cradle 10, until the inclined face of the fitting tongue 12*d* is forced against the second end side portion 11*d*, provoking an elastic deformation thereof, until said fitting tongue 12*d* reaches an opening provided in the second end side portion 11*d*, remaining retained therein against involuntary disengaging displacements. In this condition, the second cradle portion 12 is retained against any movement in relation to the first cradle portion 11. After this mounting operation, the cradle 10 receives the gripping means 20 in the form of a clamp 21.

In the illustrated construction, the second cradle portion 12 presents, from a rear outer surface, a reinforcing rib 12*e*.

The clamp 21 presents an end portion 21*a*, for fixation of the casing 1 and an opposite end portion 21*b*, seated against an outer surface of the second cradle portion 12, forcing this against the first cradle portion 11. The fixation of the first end portion 21*a* to the casing 1 is obtained by appropriate means, such as screw, rivet, glue, welding, etc. In another constructive option (not illustrated), the clamp 21 is incorporated, in a single piece, through its first end portion 21*a*, to the casing 1, from the inner surface thereof.

In the illustrated construction for the clamp 21, this presents a contour defined to permit an elastic deformation from its opposite end portion 21*b*, for the fitting of the two cradle portions 11, 12 lodging the energizing cables 4. The opposite end portion 21*b* of the clamp 21 is constantly forced against an adjacent portion of the inner surface of the casing 1. The clamp 21 also presents a structural reinforcing rib 21*e* which seats against the structural rib 12*e* of the second cradle portion 12.

In a third construction for the immobilizing means I of the present invention, illustrated in FIGS. 8-11, this comprises a single cradle 10 which simultaneously and jointly lodges an extension portion of all the energizing cables 4. In this construction, each cradle portion 11, is defined so that each energizing cable 4 has its cross section at least partially lodged in one of the cradle portions 11, 12, said energizing cable 4 being disposed adjacent to another energizing cable 4. Also in this construction, the extension of each energizing cable 4, internal to the casing 1, can be retained in at least one adjacent cradle 10 aligned to another cradle 10 and to the longitudinal extension of the energizing cables 4. It should be understood that, in the case of cradles 10 being aligned to each other and to the longitudinal extension of the energizing cables 4, such cradles need not present the same construction.

In this constructive form of immobilizing means I, the cradle 10 is defined between two cradle portions 11, 12 which laterally embrace and press the extensions of all the energizing cables 4 lodged in said cradle 10. Each cradle portions 11, 12 of the cradle 10 presents a single median recess 11*a*, 12*a*, dimensioned to lodge a respective cross section portion of all the energizing cables 4 to be immobilized in said cradle 10.

In this construction, both cradle portions 11, 12 of the cradle 10 are separate pieces, one of them being operatively affixed to the compressor, internally to the casing 1, and the other being affixed and pressed to the other of said parts by at least one gripping means 20, defined, for example, by a rivet, clamp, screw, being preferably defined by a compression screw 22.

In this construction, the second cradle portion 12 comprises a lodging 15, which surrounds a ring 16 provided in the first cradle portion 11 and internally threaded to receive the compression screw 22. The lodging 15 is provided laterally to the recess 12*a*, of the second cradle portion 12, which complements the recess 11*a* provided in the first cradle portion 11, to receive the energizing cables 4.

In a particular way of carrying out the present invention, illustrated in the enclosed figures and in which the compressor carries, internal to the casing 1, an acoustic filter 5, as previously described, the first of the cradle portions 11, 12 can be externally incorporated to the acoustic filter 5. In this construction, the first of the cradle portions 11 is incorporated, in a single piece, to an outer surface of the acoustic filter 5.

According to FIGS. 8-11, two of the constructions described herein are provided in the acoustic filter 5, particularly having at least one of the first and second cradle portions 11, 12 incorporated to the outer surface of said acoustic filter 5 in positionings previously defined therein, as a function of the arrangement of the energizing cables 4 on said acoustic filter 5. One of said cradles is disposed so as to better position the energizing cables 4 next to the electric motor 2, facilitating the electric connections therebetween, the other cradle 10 being placed in the acoustic filter 5, so as to position said cradles orienting them towards the plug 3.

This construction of the immobilizing means I is disposed adjacent to the electric motor 2 of the compressor, so as to receive the energizing cables 4 electrically connected to said electric motor 2, retaining them under pressure and preventing said energizing cables 4 from submitting the respective first end 4*a* to stresses which can break the connection of said energizing cables 4 to the electric motor 2. After joining said energizing cables 4 in a portion of its extension adjacent to the electric motor 2, another extension portion thereof is conducted to another immobilizing means I also carried by the acoustic filter 5, but which retains each energizing cable 4 separately, until they reach another immobilizing means I disposed in the casing 1 of the compressor, closer to the plug 3 in said casing 1. Between the immobilizing means I described herein, other immobilizing means can be also provided in the interior of the casing 1, so as to better orient the disposition of the energizing cables 4 between the electric motor 2 and the plug 3 of the compressor.

In the solutions for the immobilizing means I presented herein, the cradles 10 are provided to guarantee a determined distance between each energizing cable 4 and the adjacent surface portion in which an immobilizing means I is mounted. This prevents said energizing cables 4, even presenting a minimal chance of swinging due to vibrations of the compressor, during its operation or transportation, from maintaining contact with the adjacent surface of the compressor inside the casing thereof, avoiding wear of the insulating portion of the energizing cable 4, thereby guaranteeing the reliable operation of the compressor.

The invention claimed is:

1. A mounting arrangement for the energizing cables of an electric motor of a refrigeration compressor, said electric motor being mounted in the interior of a casing of the compressor, said energizing cables presenting an end connected to the electric motor and an opposite end operatively connected to a power source external to the casing, through the latter, said arrangement comprising at least one immobilizing means mounted internally to the casing, so as to retain the energizing cables, and hold an elongated portion of the energizing cables in a predetermined position within the interior of the casing, said immobilizing means comprising a plurality of cradles, defined so that each energizing cable has its cross section at least partially lodged in a respective cradle disposed laterally adjacent to another energizing cable lodged in another adjacent cradle, the elongated portion of each energizing cable within the casing, the elongated portion being retained in at least one cradle, the cradles being arranged in at least one set of cradles, the cradles of one set being disposed laterally adjacent to one another, each cradle being defined between two cradle portions which laterally embrace and press a respective energizing cable, characterized in that the two cradle portions of each cradle are separate pieces, a first piece being affixed to the compressor, internally to the casing and the other piece being attached and pressed to the first piece by at least one gripping means, at least one of the first and second cradle portions presenting at least one recess to lodge a respective cross section portion of the energizing cable immobilized in said cradle, each recess of the first cradle portion having a depression disposed along a portion of the length of the cradle so as to present a curved profile extending along a portion of the length of the cradle, the depression adapted to hold a portion of said elongated portion so as to protect said elongated portion from bending forces which can break the electrical wiring of said energizing cable.

2. The arrangement, as set forth in claim 1, characterized in that the gripping means comprises a clamp, affixed in relation to the casing and to the first cradle portion and which is conformed to press the first cradle portion against the second cradle portion.

3. The arrangement, as set forth in claim 2, characterized in that the clamp is flexible.

4. The arrangement, as set forth in claim 1, characterized in that the first cradle portion is affixed to the casing of the compressor by at least one element defined by: screw, glue, rivet, welding.

5. A mounting arrangement for the energizing cables of an electric motor of a refrigeration compressor, said electric motor being mounted in the interior of a casing of the compressor, said energizing cables presenting an end connected to the electric motor and an opposite end operatively connected to a power source external to the casing, through the latter, said arrangement comprising at least one immobilizing means mounted internally to the casing, so as to retain the energizing cables, and hold an elongated portion of the energizing cables in a predetermined position within the interior of the casing characterized in that the immobilizing means comprises a single cradle defined so that the energizing cables have the cross section thereof at least partially lodged in the cradle, the single cradle having a depression disposed along a portion of the length of the cradle so as to present a curved profile extending along a portion of the length of the cradle, each energizing cable being laterally disposed to another adjacent energizing cable, the elongated portion of each of the energizing cables supported by the curved profile of the casing and being retained in the curved profile of the cradle.

6. The arrangement, as set forth in claim 5, characterized in that the cradle is defined between two cradle portions which laterally embrace and press the energizing cables.

7. The arrangement, as set forth in claim 6, characterized in that the two cradle portions of the cradle are separate pieces, a first piece being operatively affixed to the compressor, internally to the casing, and the other being attached and pressed to the first piece, by at least one gripping means.

8. The arrangement, as set forth in claim 7, characterized in that the gripping means comprises a pressure bolt.

9. The arrangement, as set forth in claim 7, in which the compressor carries, internal to the casing, an acoustic filter, the arrangement being characterized in that the first of the cradle portions is externally incorporated to the acoustic filter.

10. The arrangement, as set forth in claim 9, characterized in that the first cradle portion and the acoustic filter is formed as a unitary piece.

11. The arrangement, as set forth in claim 7, characterized in that each of the cradle portions of the cradle presents only one median recess to lodge a respective cross section portion of the energizing cables immobilized in said cradle.

12. The arrangement, as set forth in claim 1, characterized in that the first cradle portion includes a rear projection for anchoring and directing each energizing cable lodged in the recess of said first cradle portion, said rear projection extending beyond an end portion of the first cradle portion and free of the second cradle portion, the rear projection having a number of rear recesses corresponding with the plurality of recesses of the first cradle portion, and each of the rear recesses of the rear projection being aligned with a respective recess of the first cradle portion.

* * * * *